United States Patent [19]

Sakoe et al.

[11] 4,157,457

[45] Jun. 5, 1979

[54] FREQUENCY ANALYZER COMPRISING A DIGITAL BAND-PASS AND A DIGITAL LOW-PASS FILTER SECTION BOTH OPERABLE IN A TIME-DIVISION FASHION

[75] Inventors: Hiroaki Sakoe; Seibi Chiba, both of Tokyo, Japan

[73] Assignee: Nippon Electric Co., Ltd., Tokyo, Japan

[21] Appl. No.: 883,971

[22] Filed: Mar. 6, 1978

[30] Foreign Application Priority Data

Mar. 4, 1977 [JP] Japan ..... 52-23610

[51] Int. Cl.[2] ..... G10L 1/00

[52] U.S. Cl. ..... 179/1 SA; 179/1 SC; 364/485

[58] Field of Search ..... 179/1 SA, 1 SC; 364/484, 485, 724, 725, 728

[56] References Cited

FOREIGN PATENT DOCUMENTS 5532863 10/1976 U.S.S.R. ..... 364/485

OTHER PUBLICATIONS

T. Bially et al., "A Digital Channel Vocoder," IEEE Trans. Comm. Tech., Aug. 1970, pp. 435–441.

J. Allen et al., "A Unified Approach to Short-Time Fourier," Proc. IEEE, Nov. 1977, pp. 1558–1564.

*Primary Examiner*—Kathleen H. Claffy

*Assistant Examiner*—E. S. Kemeny

*Attorney, Agent, or Firm*—Sughrue, Rothwell, Mion, Zinn and Macpeak

[57] ABSTRACT

A frequency analyzer of a predetermined number of channels comprises a digital band-pass and a digital low-pass filter section. A preselected number of digital samples sampled with a sampling period are stored in a buffer memory to be read out in each sampling period. A band-pass parameter memory memorizes for the respective channels band-pass filter impulse responses, each having preselected values, equal in number to the preselected number. A band-pass filter calculator calculates a convolution of each read-out digital sample and the preselected values of each response. The low-pass filter section produces frequency analysis results for the respective channels in each analyzing frame period equal to a first prescribed number of the sampling periods. A low-pass filter impulse response having a duration equal to the frame period multiplied by a second prescribed number and prescribed values, the predetermined number in each sampling period, is memorized in a low-pass parameter memory with its phase or the duration successively shifted by the frame period. A multiplier calculates products of each convolution and the prescribed values of the respective memorized responses read out in an interval of production of that convolution. Absolute values of the products are accumulated in an accumulator register memory according to the respective channels and the respective phases and produced therefrom as the analysis results for the respective channels in those of the sampling periods which are spaced by the frame period and at which the respectively shifted durations have ends, respectively.

5 Claims, 24 Drawing Figures

FIG 2
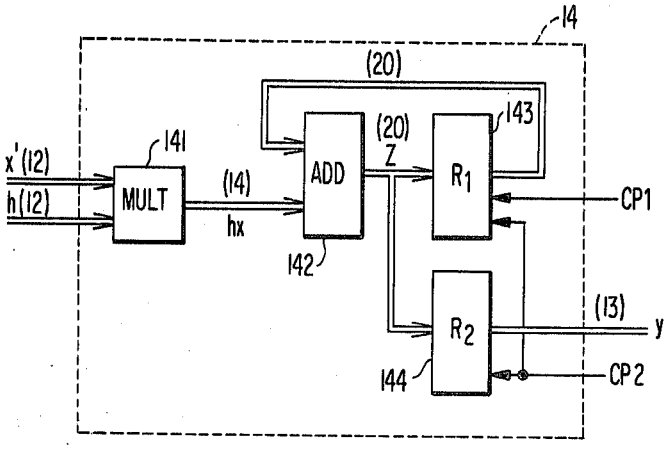
FIG 3A x'
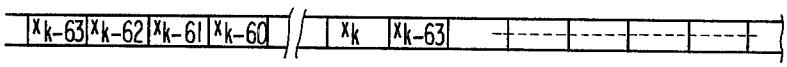
FIG 3B h
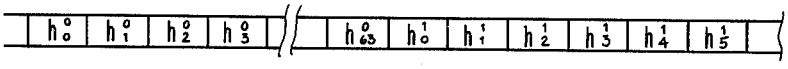
FIG 3C CP1
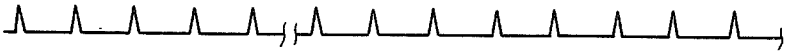
FIG 3D (R1)
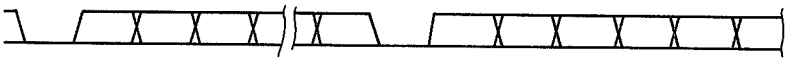
FIG 3E CP2
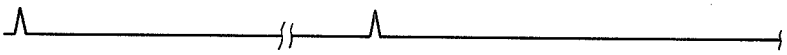
FIG 3F y
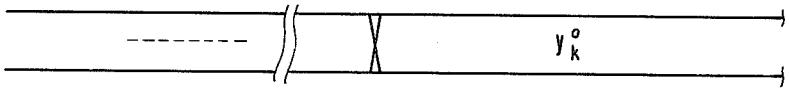
FIG 4A P1
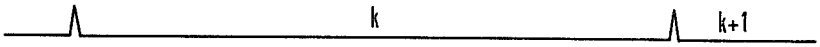
FIG 4B CP2
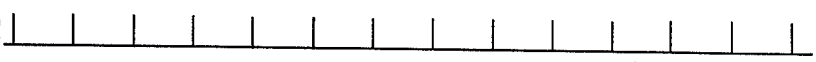
FIG 4C n
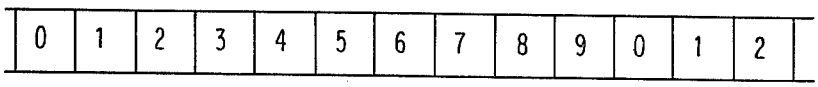
FIG 4D y
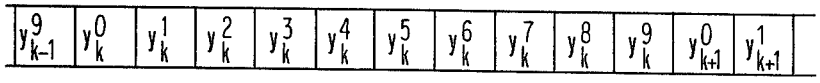

FIG 5
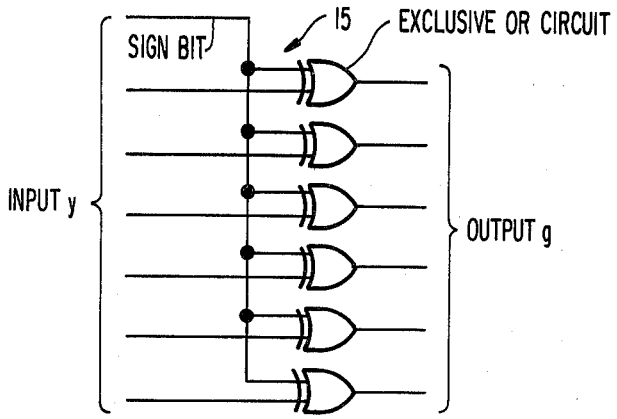
FIG 6A
FIG 6B
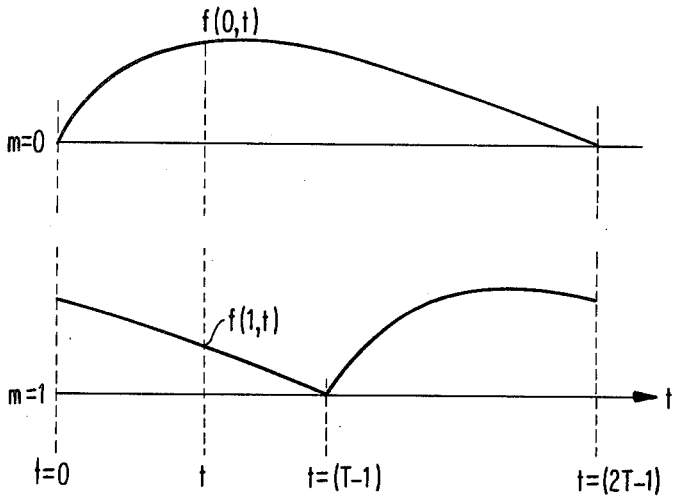
FIG 7A
FIG 7B
FIG 7C
FIG 7D
FIG 7E
FIG 7F
FIG 7G
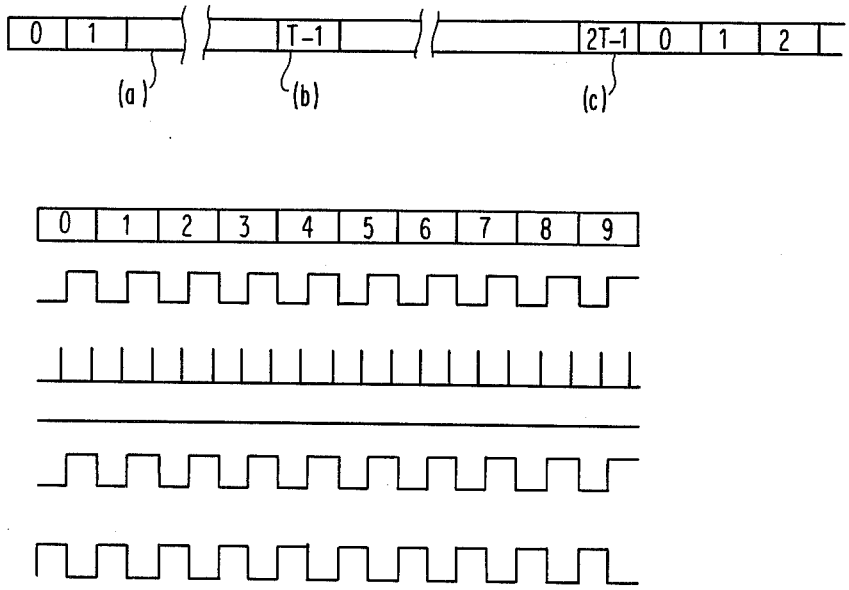

FREQUENCY ANALYZER COMPRISING A DIGITAL BAND-PASS AND A DIGITAL LOW-PASS FILTER SECTION BOTH OPERABLE IN A TIME-DIVISION FASHION

BACKGROUND OF THE INVENTION

This invention relates to a digital frequency analyzer for frequency-analyzing various signals, such as a speech signal, into frequency components.

Frequency analyzers are widely used in vocoders and speech recognition systems. As illustrated by M. R. Schroeder in "Vocoders: Analysis and Synthesis of Speech", *Proceedings of the IEEE,* Vol. 54, No. 5 (May 1966), pages 720–734, with reference to FIG. 6 (Page 724), a conventional frequency analyzer comprises a predetermined number of analyzer channels each comprising a series connection of an analog band-pass filter of an individually preselected passband, an analog rectifier, and an analog low-pass filter of a commonly prescribed cutoff frequency. The number of channels is about ten or more in most cases so that use has to be made of ten or more band-pass filters, rectifiers, and low-pass filters each. The frequency analyzers have, therefore, been bulky and expensive. Above all, the low-pass filters must have a sufficiently large time constant in order to thoroughly remove ripples from the frequency components of the respective channels and have consequently been massive and costly.

SUMMARY OF THE INVENTION

It is, therefore, an object of the present invention to provide a frequency analyzer which is compact and low-priced.

It is another object of this invention to provide a frequency analyzer of the type described, which comprises a compact and low-priced, low-pass filter section serving as a prescribed number of low-pass filters.

Broadly speaking, a frequency analyzer according to this invention is characterized by the fact that the filter processing is carried out by putting a digital filter into operation in a time-division fashion.

There is provided in accordance with this invention a digital frequency analyzer responsive to those digital samples of a frequency analyzer input signal which are supplied thereto in successive sampling periods, respectively, for producing a frequency analyzer output signal representative of those frequency analysis results of a predetermined number of channels into which the input signal is frequency analyzed for every analyzing frame period equal to a first prescribed number of the sampling periods. Each of the sampling periods is equal to a predetermined number of intervals. The digital frequency analyzer comprises (1) a buffer memory for memorizing a preselected number of the digital samples with the memorized digital samples renewed in every sampling period and (2) a band-pass filter section for subjecting the memorized digital samples to preselected band-pass filter processing to successively produce band-pass filter results for the respective channels in every sampling period. The band-pass filter results are thus successively produced in the respective intervals. Each of the band-pass filter results has an absolute value. The digital frequency analyzer further comprises (3) a low-pass filter section memorizing a low-pass filter impulse response having a start and an end point and prescribed values in that duration between the start and the end points which are equal to a second prescribed number of the frame periods and also memorizing the impulse response with its phase, namely, the duration, shifted by the frame period successively as often as the second prescribed number for calculating products of each of the band-pass filter results and the prescribed values read in the interval of production of the above-mentioned each band-pass filter result out of the impulse responses memorized with the phase unshifted and shifted, for accumulating according to the respective channels and the respective phases the absolute values of the successively calculated products, and for producing as the frequency analysis results the accomulated products for the respective channels in those of the sampling periods in which the memorized impulse responses have the respective end points.

BRIEF DESCRIPTION OF THE DRAWINGS

In the drawings:

FIG. 2 is a block diagram of an example of a filter calculator for use in the frequency analyzer shown in FIG. 1;

FIGS. 3A to 3F are time charts for illustrating the operation of the filter calculator shown in FIG. 2;

FIGS. 4A to 4D are time charts for describing the operation of a band-pass filter section of the frequency analyzer comprising the filter calculator shown in FIG. 2;

FIG. 5 shows an example of an absolute value circuit for use in the frequency analyzer depicted in FIG. 1;

FIGS. 6A and 6B illustrate a two-phase impulse response memorized in an example of a low-pass filter section used in the frequency analyzer depicted in FIG. 1;

FIGS. 7A to 7G show time charts, in four parts, one at the top and the other three in a lower area with the time axis expanded as compared with that for the top, for illustrating the operation of the low-pass filter section.

DESCRIPTION OF THE PREFERRED EMBODIMENTS

It is pointed out at the outset that signals are designated in several figures of the accompanying drawings by reference letters, each together with the number of bits represented by numerals enclosed with parentheses. Where the numbers of bits are given for some signals, reference letters accompanied by no numeral designate one-bit signals.

Figure 1:
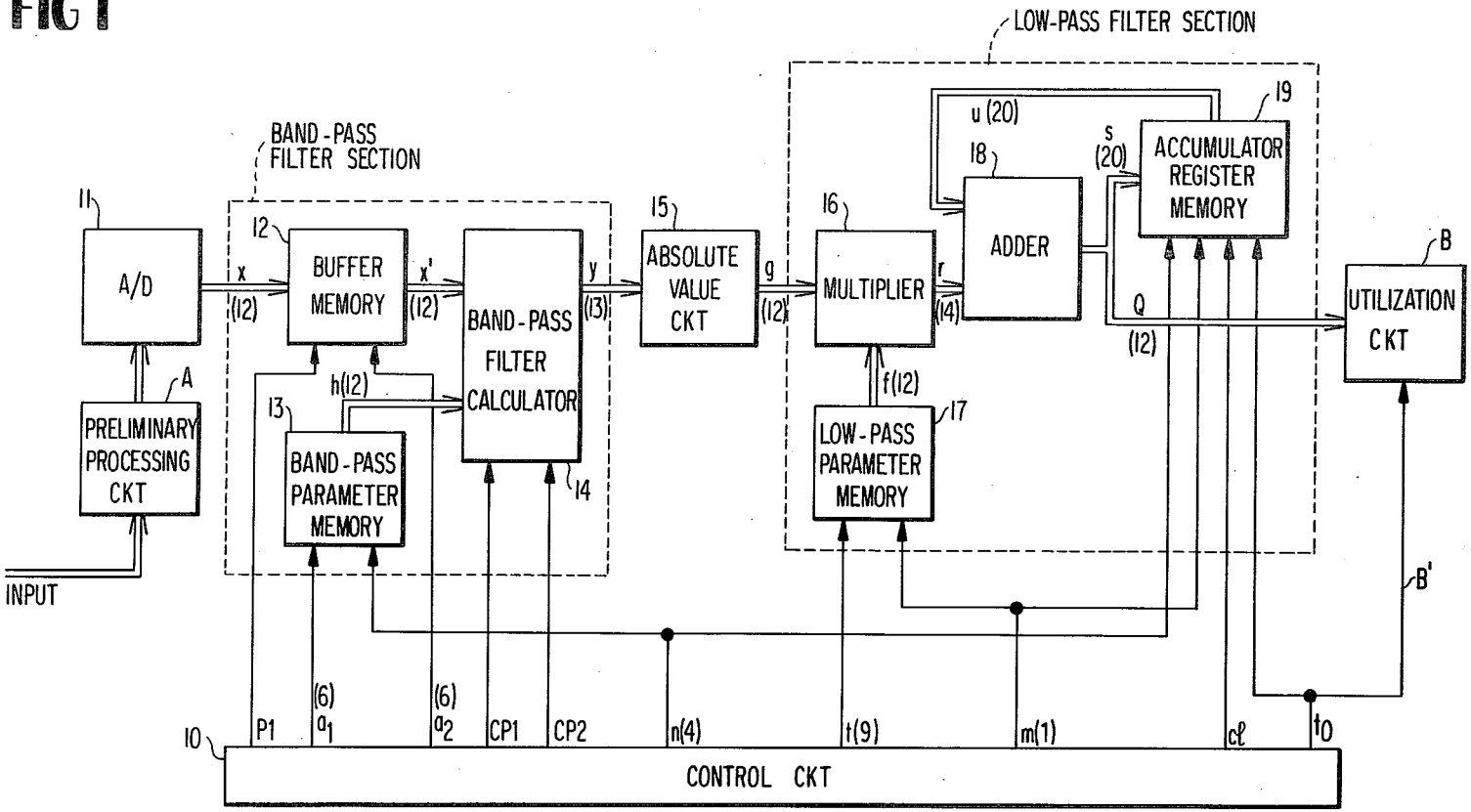
FIG. 1 is a block diagram of a digital frequency analyzer according to a preferred embodiment of the instant invention.

Referring now to FIG. 1, a digital frequency analyzer according to a preferred embodiment of the present invention comprises a known preliminary processing circuit A comprising, in turn, a low-pass filter (not shown) for removing unnecessarily higher frequency components of a frequency analyzer input signal and a sample-hold circuit (not shown) for successively producing analog samples of the filtered input signal at successive sampling instants of a sampling period, which is a relatively longer period, as will become clear as the description proceeds, as compared with other periods used in the frequency analyzer according to the preferred embodiment and maybe, for example, 80 microseconds. Inasmuch as the preliminary processing is customarily resorted to in the field of digital filters, details thereof are not illustrated. A control circuit 10 generates various control signals which specify addresses of several memories used in the frequency analyzer and for timing the operation of elements or units of the analyzer and will also become clear as the description proceeds. Although not depicted in detail, the control circuit 10 may comprise counters and decoders coupled thereto. Alternatively, the counters may be connected to a read-only memory in which the control signals are preliminarily stored. The analog samples are supplied to an analog-to-digital converter 11, which successively produces digital samples x. The digital sample produced at a sampling instant i will be designated by $x_i$. Controlled by pertinent ones of the control signals as detailed later, a band-pass filter section comprising a buffer memory 12, a band-pass parameter memory 13, and a filter calculator 14 serves as a predetermined number of band-pass filters. A preselected number of the digital samples x are written into the buffer memory 12 in synchronism with a control pulse sequence P1 of the sampling frequency. By way of example, the buffer memory 12 has a capacity for sixty-four samples to memorize.

$$x_{k-63}, x_{k-62}, \ldots, x_i, \ldots, x_{k-1}, \text{ and } x_k$$

at each sampling instant k. The band-pass parameter memory 13 stores parameters descriptive of preselected characteristics of the band-pass filters. More particularly, the band-pass parameter memory 13 memorizes, as the band-pass parameters, those band-pass filter impulse responses which give the preselected band-pass characteristics for the respective channels. It is possible to design a digital filter having preselected filter characteristics when reference is had to the teaching of Donald W. Tufts et al. in "Designing Simple, Effective Digital Filters", *IEEE Transactions on Audio and Electroacoustics,* Vol. AU-18, No. 2 (June 1970), pages 142–158. A band-pass filter impulse response $h^n$ for an n-th channel is herein represented by a sequence of terms or preselected values by:

$$h^n = h_0^n, h_1^n, \ldots, h_i^n, \ldots, h_{63}^n$$

when the common length of such responses is given by the preselected number, namely, sixty-four, of taps. It is now presumed that the digital frequency analyzer is a ten-channel analyzer, when the band-pass parameter memory 13 memorizes ten impulse responses $h^0, h^1, \ldots, h^9$ for the respective channels. The filter calculator 14 is of a non-recursive type and calculates a convolution of the digital samples x memorized in the buffer memory 12 and each of the impulse responses h stored in the band-pass parameter memory 13 to produce a band-pass filter output signal y representative successively of those band-pass filter results $y_k^n$ for the respective channels 0, 1, . . . , and 9 which are given by:

$$y_k^n = \sum_{i=0}^{63} h_i^n \cdot x_{k-63+i} \qquad (1)$$

for the n-th channel at each instant k as will be later explained in more detail.

Referring temporarily to FIGS. 2 and 3A to 3F, and example of the filter calculator 14 comprises a multiplier 141. Supplied with a first address signal $a_1$ from the control circuit 10, the band-pass parameter memory 13 supplies the multiplier 141 with a band-pass filter impulse response signal h successively representative of the preselected values $h_i^n$ of the impulse response $h^n$ that is specified by a channel selection signal n delivered thereto also from the control circuit 10. Supplied with a second address signal $a_2$ from the control circuit 10, the buffer memory 12 successively delivers the memorized digital samples $x_i$ to the multiplier 141 as a memorized digital sample signal x'. The multiplier 141 calculates products h·x to produce a product signal hx representative successively of the products h·x. An adder 142 calculates a sum of each product h·x and the content (FIGS. 3D) of the first register 143 ($R_1$) to produce a sum signal z, which supplied back to the register 143 to be written therein in synchronism with a first clock pulse sequence CP1 shown in FIG. 3C supplied from the control circuit 10. The register 143 is preliminarily reset to zero by a second clock pulse sequence CP2 show in FIG. 3E produced by the control circuit 10 with a period sixty-four times as long as that of the first clock pulse sequence CP1. As best shown in FIGS. 3A and 3B, the sample signal x' and the impulse response signal h represent the digital samples and the preselected values of each impulse reponse $h^n$ in the order of:

$$x_{k-63}, x_{k-62}, \ldots, x_k$$

and $$h_0^n, h_1^n, \ldots, h_{63}^n,$$

respectively. Responsive to the second clock pulse sequence CP2, that one of the sums represented by the sum signal z which is produced in synchronism therewith is written in a second register 144 ($R_2$), which thus produces the band-pass filter output signal y shown in FIG. 3F representative of the convolution $y_k^n$ given by Equation (1).

Turning back to FIG. 1 and referring anew to FIGS. 4A to 4D, the channel selection signal n is produced in synchronism with the second clock pulse sequence CP2 shown in FIG. 4B to repeatedly specify the channels, such as cyclically from the zeroth channel to the ninth channel, in each sampling period given by the control pulse sequence P1 shown in FIG. 4A. The band-pass filter output signal y (FIG. 4D), therefore, represents, in a sampling period k, the band-pass filter results $y_k^0, y_k^1, \ldots$, and $y_k^9$ for the respective channels and, in a next succeeding sampling period (k+1), the results $y_{k+1}^0, y_{k+1}^1, \ldots$, and $y_{k+1}^9$. An absolute value circuit 15 corresponds to the rectifiers shown in the above-referenced Schroeder article and is supplied with the band-pass filter output signal y to deliver an absolute value signal g representative of the absolute values $|y_k^n|$ of the respective band-pass filter results $y_k^n$ to a low-pass filter section described hereunder.

Turning temporarily to FIG. 5, an example of the absolute value circuit 15 for a band-pass filter output signal y consisting of a sign bit signal and a plurality of data bit signals giving the absolute value in the form of two's complement comprises Exclusive OR circuits supplied with the sign bit signal and the respective data bit signals. Output signals of the Exclusive OR circuits give approximately the absolute value. When the band-pass filter output signal y consists of a sign bit and bits representative of the absolute value, the absolute value circuit 15 may be a circuit for merely neglecting the sign bit.

Turning back to FIG. 1 again, the low-pass filter section comprises a multiplier 16, a low-pass parameter memory 17, an adder 18, and an accumulator register memory 19. The low-pass filter processing may be carried out as in a digital nonrecursive filter as is the case with the band-pass filter processing. More particularly, it is possible to have a common impulse response of the low-pass filters of prescribed characteristics memorized as a function $f_i$ of the sampling instants i. The length of duration of the impulse response is given by the number of taps $T_p$. In this event, as many low-pass filter input samples $g_i$ should also be memorized as the number of taps $T_p$. An impulse response $q_k$ of the low-pass filter section at a sampling instant k is now given by:

$$q_k = \sum_{i=0}^{T_p-1} f_i \cdot g_{k-(Tp-1)+i} \qquad (2)$$

by calculating a convolution as is the case with Equation (1). It is, however, necessary for obtaining with the low-pass filter section a sufficiently smoothed output signal to use several times as many taps as those for the band-pass filter impulse responses. Faithful calculation of Equation (2), therefore, requires an enormously large amount of calculation and bulky memories. Moreover, the input samples $g_i$, equal in number to the number of taps $T_p$, have to be memorized for the respective channels. The latter fact necessitates a terribly bulky memory. The fact is, therefore, taken into consideration that it is sufficient to calculate the low-pass filter results only at every analyzing frame period T, described later, rather than at every sampling instant k. The frame period T may be equal to 250 sampling periods, namely, 20 milliseconds. Under the circumstances, it becomes sufficient to calculate Equation (2) only at those of the sampling instants k which appear at integral multiples of the frame period T. Furthermore, a memory corresponding to the buffer memory 12 is rendered unnecessary provided that use is made of registers for accumulating the products of the impulse response function $f_i$ and the low-pass filter input samples $g_{k-Tp+1+i}$ necessary for the calculation of Equation (2). At any rate, the number of taps $T_p$ for which the products should be summed up is, in practice, several times as many as the sampling periods of which each frame period T consists. This is for achieving sufficient smoothing. The arrangement according to this invention is, therefore, such that use is made of the accumulator register memory 19 comprising a plurality of unit accumulator registers (not individually shown) for individually accumulating therein the products of the input samples $g_i$ and those points on the impulse response which have different phases and that the contents of the accumulator registers are read out at every frame period T with the phase shifted so as to provide a low-pass filter output signal Q.

Referring to FIG. 1 once again and to FIGS. 6A and 6b afresh, an example of the low-pass filter section will be described wherefore the length or duration of the low-pass filter impulse response is set at twice the analyzing frame period T, namely, at 40 milliseconds. This means that the number of taps $T_p$ is set at 500. As best shown in FIGS. 6A and 6B, the impulse response is stored in the low-pass parameter memory 17 in duplicate with its phase or duration divided into two parts as m-th phase impulse responses f(m, t) for m=0 and 1. The symbol t will shortly be described. Supplied from the control circuit 10 with a timing signal t and a phase selection signal m, both described later in detail, the low-pass parameter memory 17 produces a low-pass filter impulse response signal f representative of the impulse responses f(m, t) of the phases m and at the time instants t.

Referring to FIG. 1 again and to FIGS. 7A to 7G anew, the accumulator register memory 19 for the example of the low-pass filter section has addresses (n, m) specified by the channel and the phase selection signals n and m produced by the control circuit 10. The content of the (n, m)-th address is designated herein by u(n, m). As best shown in FIG. 7A, the timing signal t supplied from the control circuit 10 repeatedly increases from 0 to $(T_p-1)$, namely, (2T−1) or 499, in synchronism with the sampling instants for the analyzer input signal. In each timing period exemplified in FIG. 7B the channel and the phase selection signals n and m and a write-in clock pulse sequence cl vary as depicted in FIGS. 7C to 7E with the time axis expanded. An output synchronization digtal $t_0$ depicted in FIG. 7F will be described later.

Referring further to FIGS. 1 and 7A to 7G, it may be summarized here that the absolute value circuit 15 produces the absolute value signal g that successively represents in each timing period t the absolute values of the band-pass filter results $y_k^n$ for the respective channels in synchronism with the channel selection signal n. For each channel signal n, the phase selection m specifies the zeroth phase at first and subsequently the first phase. At m=0, a content signal u read out of the accumulator register memory 19 and the impulse response signal f of the low-pass parameter memory 17 are representative of u(n, 0) and f(0, t), respectively. The signals g and f are supplied to the multiplier 16 to become a product signal r representative of a product of the two signals. A sum of the product signal r and the content signal u is calculated by the adder 18 to produce a sum signal s, which is written in synchronism with the write-in clock pulse sequence cl into the accumulator register memory 19 as a new content u(n, 0). At m=1, the signals u(n, 1) and f(n, 1) are read out of the accumulator register memory 19 and the low-pass parameter memory 17 are similarly processed as described for m=0 to provide a new content u(n, 1), which is written in the accumulator register memory 19.

Figure 8A:
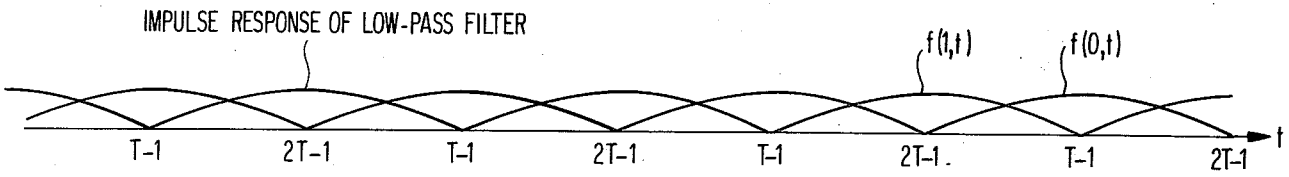
FIGS. 8A and 8B are time charts for describing the operation of the low-pass filter section.
Figure 8B:
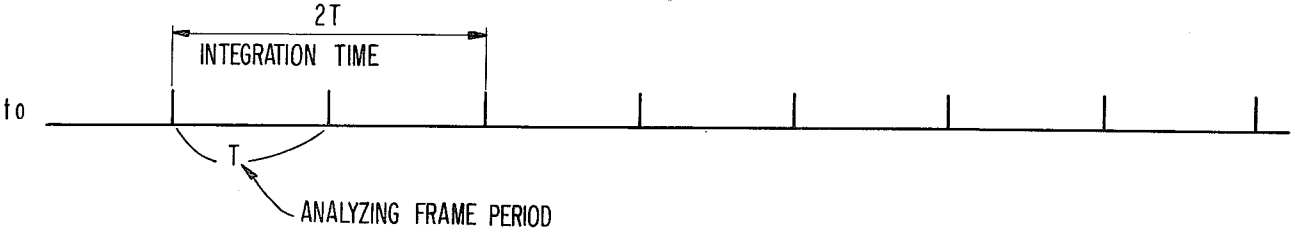

Referring to FIGS. 1 and 7A to 7G once again and to FIGS. 8A and 8B afresh, the output synchronization signal $t_0$ is produced by the control circuit 10 only when m=1 in the (T−1)-th or 249th timing period and when m=0 in the (2T−1)-th or 499th timing period. This is clearly illustrated in FIG. 7A at (a), (b) and (c) and in FIGS. 7B to 7G. Supplied to the accumulator register memory 19, the output synchronization signal $t_0$ resets to zero the content u(n, m) of the address (n, m) specified by the channel and the phase selection signals n and m produced simultaneously therewith. The sum signal s is supplied to a utilization device B as the low-pass filter output signal Q and received thereby as a frequency analyzer output signal in synchronism with the output synchronization signal $t_0$, which is produced at t=(T−1) or the 249th timing period and t=(2T−1) or the 499th. To this end, a connection B′ is extended to the unitilization device B. As best shown in FIGS. 8A and 8B, the analyzer output signal represents those frequency analysis results, each of which is a convolution integral of the impulse response memorized in the low-pass parameter memory 17 and the absolute values g of the band-pass filter results successively produced in each integration time 2T following the instant at which the timing signal t specified one cycle before the (T−1)-th or the (2T−1)-th timing period. Summarizing, the above-described low-pass filter processing is equivalent to channel-parallel processing carried out at every interval of the analyzing frame period T by a non-recursive digital filter of the number of taps $T_p$ given by 2T or 500.

By virtue of a low-pass filter section exemplified above, a frequency analyzer according to this invention has the following salient features. At first, calculation of the low-pass convolutions only at every interval of the analyzing frame period greatly reduces the amount of necessary calculation as compared with calculation of the low-pass convolutions at every sampling period. Secondly, the buffer memory capacity is much reduced as compared with that capacity for a conventional non-recursive digital filter which has to be sufficient for an integration time of 2T for each of the channels. For example, an accumulator register memory for only twenty words is sufficient with the above-illustrated example for ten-channel analysis with duplicated phase. In the third place, it is possible to use the low-pass parameter memory 17 of a small capacity because the low-pass filter impulse response is common to all channels.

On describing an example of the low-pass filter section, it has been assumed that the number of taps $T_p$ that corresponds to the integration time is twice the analyzing frame period T. It is obvious that the factor may be three or more. For example, let the number of taps $T_p$ be four times the frame period T. It is possible in this event to store the impulse response in the low-pass parameter memory 17 in four phases and to enable the addresses of the accumulator register memory 19 to be specified as regards the phase selection signal m by four phases 0, 1, 2 and 3.

As described, it is possible to use a digital frequency analyzer as an analyzer unit of a speech recognition system. In this case, the low-pass filter sum signal s is used for recognition of speech sounds. Use is also possible as an analyzer unit of a channel vocoder. In the latter case, the sum signal s is transmitted to a channel vocoder receiver.

While this invention has thus far been described mainly in conjunction with a preferred embodiment thereof, it should be clearly understood that the circuit elements are illustrated merely by way of example and not to impose any limitation on the scope of this invention. Above all, it is possible to design the band-pass filter section as a recursive digital filter rather than as a non-recursive one. It is not necessary that the absolute value circuit 15 be an independent unit. Omission is possible by giving a subtraction function to the adder 18 and switching between addition and subtraction with reference to the successive sign bits of the band-pass filter output signal y. The illustrated number of bits should be adapted to the common number of taps of the band-pass filter impulse responses, the tap number $T_p$ of the low-pass filter impulse response, and others. In connection with the memory addresses, the channels, the phases of the low-pass filter impulse response, and the like should be numbered so as to be in one-to-one correspondence to integers 0, 1 and so on. Although the impulse responses with the phase unshifted and shifted are stored in the low-pass filter section, an impulse response corresponding to the phase shifted may be made on the basis of one common impulse response stored in the low-pass filter section by modifying an address signal given from the control circuit 10 depending on the phase shift.

What is claimed is:

1. A digital frequency analyzer responsive to those digital samples of a frequency analyzer input signal which are supplied thereto in successive sampling periods, respectively, for producing a frequency analyzer output signal representative of those frequency analysis results of a predetermined number of channels into which said input signal is frequency analyzed for every analyzing frame period equal to a first presecribed number of said sampling periods, each of said sampling periods being equal to a predetermined number of intervals equal to the number of channels, said digital frequency analyzer comprising:

a buffer memory for memorizing a preselected number of said digital samples with the memorized digital samples renewed in every sampling period;

a band-pass filter section for subjecting said memorized digital samples given from said buffer memory to preselected band-pass filter processing to successively produce band-pass filter results for the respective channels in every sampling period, the band-pass filter results being thus successively produced in the respective intervals; and a low-pass filter section generating a low pass filter impulse response having a start and an end point and prescribed values in that duration between said start and said end points which is equal to a second prescribed number of said frame periods and also generating the impulse response with its phase, namely, the duration, shifted by said frame period successively as often as said second prescribed number for calculating products each of said band-pass filter results and the prescribed values read in the interval of production of said each band-pass filter results out of the impulse responses generated with the phase unshifted and shifted, for accumulating absolute values of products successively calculated for the respective channels and the respective phases, and for producing as said frequency analysis results the accumulated products for the respective channels in those of said sampling periods in which the generated impulse responses have the respective end points.

2. A digital frequency analyzer as claimed in claim 1, further comprising a control circuit for producing a timing signal specifying, in the duration of the low-pass filter impulse response generated with the phase unshifted, the respective sampling periods by the use of first serial numbers corresponding to zero through a final number equal to said first prescribed number multiplied by said second prescribed number and minus one, a channel selection signal specifying in each of said sampling periods the respective channels by the use of second serial numbers corresponding to zero through said predetermined number less one, a phase selection signal specifying in each of said intervals the respective phases by the use of third serial numbers corresponding to zero through said second prescribed number less one, a write-in clock pulse sequence in synchronism with said phase selection signal, and an output synchronization signal in synchronism, in those of said sampling periods which are specified by those of said first serial numbers which correspond to said first prescribed number multiplied by one through said second prescribed number minus one, with those portions of said phase selection signal which specify the respective phases by those respective ones of said third serial numbers which are equal to the last-mentioned ones of said first serial numbers, wherein said low-pass filter section comprises:

means responsive to said band-pass filter results for producing the absolute values of the respective band-pass filter results;

a low-pass parameter memory for generating the low-pass filter impulse responses of the respective phases;

means responsive to said timing signal and said phase selection signal for successively reading out of said low-pass parameter memory in each of said intervals the prescribed values of the impulse responses of the phases specified by said third serial numbers, respectively;

a multiplier for successively calculating the products of the absolute value of each of said band-pass filter results and the prescribed values successively read out of said low-pass parameter memory in the interval of production of the last-mentioned each band-pass filter results;

an adder for successively calculating sums of the products and addends in each of said intervals;

an accumulator register memory having addresses specifiable by combinations of said channel and said phase selection signals, respectively, for substitutably memorizing contents, respectively;

means supplied with said channel and said phase selection signals for reading the contents out of the accumulator register memory addresses specified by the respective combination of the channel and the phase selection signals supplied thereto;

means for supplying the read-out contents to said adder as said addends;

means responsive to said write-in clock pulse sequence for successively substituting for the contents read out of the respective accumulator register addresses the sums calculated by the use of the respective read-out contents; and means responsive to said output synchronization signal for producing the sums as said frequency analysis results.

3. A digital frequency analyzer as claimed in claim 2, wherein said control circuit further produces a first control pulse sequence of a first repetition period equal to each of said intervals, a second control pulse sequence of a second repetition period equal to said first repetition period divided by said preselected number, and a first and a second address signal in synchronism with said second control pulse sequence for cyclically specifying addresses, equal in number to said preselected number, said buffer memory having addresses specifiable by said second address signal for said memorized digital samples, respectively, wherein said band-pass filter section comprises:

means responsive to said second address signal for successively reading said memorized digital samples out of said memory;

a band-pass parameter memory having addresses for memorizing band-pass filter impulse responses, equal in number to said preselected number, in the addresses specifiable by said channel selection signal, respectively, each of the memorized band-pass filter impulse responses having preselected values memorized in the band-pass parameter memory addresses specifiable by said first address signal, respectively;

means responsive to said channel selection signal and said first address signal for reading the preselected values out of the band-pass parameter memory addresses specified by said first address signal for each of said band-pass filter impulse responses for which the band-pass parameter memory addresses are specified by said channel selection signal; and a filter convolution calculator responsive to said first and said second control pulse sequences for calculating in each of said second repetition periods a convolution of the readout digital samples and the preselected values of each of said band-pass filter impulses responses to provide each of said band-pass filter results.

4. A digital frequency analyzer as claimed in claim 1, further comprising a control circuit for producing a timing signal specifying in the duration of the low-pass filter impulse response generated with the phase unshifted, the respective sampling periods by the use of first serial numbers corresponding to zero through a final number equal to said first prescribed number multiplied by said second prescribed number minus one, a channel selection signal specifying in each of said sampling periods the respective channels by the use of second serial numbers corresponding to zero through said predetermined number less one, a phase selection signal specifying in each of said intervals the respective phases by the use of third serial numbers corresponding to zero through said second prescribed number less one, a write-in clock pulse sequence in synchronism with said phase selection signal, and an output synchronization signal in synchronism, in those of said sampling periods which are specified by those of said first serial numbers which corresponds to said first prescribed number multiplied by one through said second predetermined number minus one, with those portions of said phase selection signal which specify the respective phases by those respective ones of said third serial numbers which are equal to the last-mentioned ones of said first serial numbers, wherein said low-pass filter section comprises:

low-pass parameter memory for generating the low-pass filter impulse responses of the respective phases;

means responsive to said timing signal and said phase selection signal for successively reading out of said low-pass parameter memory in each of said intervals the prescribed values of the impulse responses of the phases specified by said third serial numbers, respectively;

a multiplier for successively calculating the products of each of said band-pass filter results and the prescribed values successively read out of said low-pass parameter memory in the interval of production of the last-mentioned each band-pass filter results;

adder means for successively calculating sums of the absolute values of the respective products and addends in each of said intervals;

an accumulator register memory having addresses specifiable by combination of said channel and said phase selection signals, respectively, for substitutably memorizing contents, respectively;

means supplied with said channel and said phase selection signals for reading the contents out of the accumulator register memory addresses specified by the respective combinations of the channel and the phase selection signals supplied thereto;

means for supplying the read-out contents to said adder means as said addends;

means responsive to said write-in clock pulse sequence for successively substituting for the contents read out of the respective accumulator register memory addresses the sums calculated by the use of the respective read-out contents; and means responsive to said output synchronization signal for producing the sums as said frequency analysis results.

5. A digital frequency analyzer as claimed in claim 4, wherein said control means further produces a first control pulse sequence of a first repetition period equal to each of said intervals, a second control pulse sequence of a second repetition period equal to said first repetition period divided by said preselected number, and a first and a second address signal in synchronism with said second control pulse sequence for cyclically specifying addresses, equal in number to said preselected number, said buffer memory having addresses specifiable by said second address signal for said memorized digital samples, respectively, wherein said band-pass filter section comprises:

means responsive to said second address signal for successively reading said memorized digital samples out of said buffer memory;

a band-pass parameter memory having addresses for memorizing band-pass filter impulse responses, equal in number to said preselected number, in the addresses specifiable by said channel selection signal, respectively, each of the memorized band-pass filter impulse responses having preselected values memorized in the band-pass parameter memory addresses specifiable by said first address signal, respectively;

means responsive to said channel selection signal and said first address signal for reading the preselected values out of the band-pass parameter memory addresses specified by said first address signal for each of said band-pass filter impulse responses for which the band-pass parameter memory addresses are specified by said channel selection signal; and a filter convolution calculator responsive to said first and said second control pulse sequences for calculating in each of said second repetition periods a convolution of the read-out digital samples and the preselected values of each of said band-pass filter impulse responses to provide each of said band-pass filter results.

* * * * *

UNITED STATES PATENT AND TRADEMARK OFFICE

CERTIFICATE OF CORRECTION

PATENT NO. : 4,157,457

DATED : June 5, 1979

INVENTOR(S) : Hiroaki SAKOE et al

It is certified that error appears in the above-identified patent and that said Letters Patent are hereby corrected as shown below:

IN THE CLAIMS

Column 8, line 53 - after "number" delete "and".

Column 10, line 13 - delete "impulses" insert -- impulse --.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*